US012458846B2

(12) United States Patent
Neuhaus

(10) Patent No.: US 12,458,846 B2
(45) Date of Patent: Nov. 4, 2025

(54) FITNESS EQUIPMENT WITH TAP CONTROL

(71) Applicant: OxeFit, Inc., Plano, TX (US)

(72) Inventor: Peter Neuhaus, Pensacola Beach, FL (US)

(73) Assignee: OxeFit, Inc., Plano, TX (US)

( * ) Notice: Subject to any disclaimer, the term of this patent is extended or adjusted under 35 U.S.C. 154(b) by 672 days.

(21) Appl. No.: 17/856,184

(22) Filed: Jul. 1, 2022

(65) Prior Publication Data

US 2024/0001200 A1 Jan. 4, 2024

(51) Int. Cl.

| | |
|---|---|
| ***A63B 24/00*** | (2006.01) |
| ***A63B 21/00*** | (2006.01) |
| ***A63B 21/005*** | (2006.01) |
| ***A63B 71/06*** | (2006.01) |

(52) U.S. Cl.

CPC ..... *A63B 24/0087* (2013.01); *A63B 21/0058* (2013.01); *A63B 21/153* (2013.01); *A63B 71/0619* (2013.01); *A63B 2071/0675* (2013.01); *A63B 2220/51* (2013.01); *A63B 2220/56* (2013.01); *A63B 2220/833* (2013.01)

(58) Field of Classification Search

CPC ..... A63B 24/0087; A63B 21/0058; A63B 21/153; A63B 71/0619; A63B 2071/0675; A63B 2220/56; A63B 2220/833

See application file for complete search history.

(56) References Cited

U.S. PATENT DOCUMENTS

| | | | | |
|---|---|---|---|---|
| 9,814,920 | B1 | 11/2017 | Monterrey | |
| 10,901,529 | B2 * | 1/2021 | Rivolta | G06F 1/1626 |
| 11,123,609 | B2 * | 9/2021 | Rubin | A63B 21/4043 |
| 11,433,276 | B2 * | 9/2022 | Bissonnette | A63B 21/00178 |
| 2008/0228110 | A1 * | 9/2008 | Berme | A63B 26/003 600/595 |
| 2011/0165996 | A1 * | 7/2011 | Paulus | A63B 22/0605 482/5 |
| 2014/0228175 | A1 * | 8/2014 | Lemos | A63B 21/0783 482/93 |
| 2019/0344115 | A1 | 11/2019 | Neuhaus et al. | |
| 2019/0344123 | A1 | 11/2019 | Rubin et al. | |
| 2021/0394011 | A1 * | 12/2021 | Neuhaus | A63B 71/0622 |

FOREIGN PATENT DOCUMENTS

| | | | | |
|---|---|---|---|---|
| WO | WO-2023/141081 | A1 | 7/2023 | |
| WO | WO-2024005376 | A1 * | 1/2024 | A63B 21/0058 |

OTHER PUBLICATIONS

International Search Report and Written Opinion on PCT/US2023/026390 dated Sep. 20, 2023 (9 pages).

* cited by examiner

*Primary Examiner* — Loan B Jimenez
*Assistant Examiner* — Kathleen M Fisk
(74) *Attorney, Agent, or Firm* — Foley & Lardner LLP

(57) ABSTRACT

Exercise equipment includes a motor, a cable coupled to the motor such that the motor is operable to create a tension in the cable, a sensor arranged to measure a parameter affected by tapping of a foot of a user of the exercise equipment, and control circuitry programmed to modify operation of the motor in response to detecting a pattern in the parameter as measured by the sensor.

20 Claims, 5 Drawing Sheets

FITNESS EQUIPMENT WITH TAP CONTROL

BACKGROUND

Aspects of the present application relate to exercise equipment, for example strength training equipment. Traditional strength training equipment uses dead weight (plates, barbells, dumbbells, kettlebells, heavy objects, etc.) which can be lifted, moved, etc. by users to complete exercises. For some exercises (e.g., squats, bench press), a person may hold a significant amount of dead weight above the person's body while attempting to complete the exercise. Meanwhile, strength training plans can direct people to deliberately push to their physical limits in order to increase strength and set new personal maximum weight and/or repetition records. Under such conditions, i.e., at that the limits of a person's athleticism, it can be difficult for the person to return weights to a rack or otherwise revert to an unloaded state to end an exercise. Such challenges can discourage people from fully attempting to approach their personal limits when performing various strength training exercises.

SUMMARY

One implementation of the present disclosure is exercise equipment including a motor, a cable coupled to the motor such that the motor is operable to create a tension in the cable, a sensor arranged to measure a parameter affected by tapping of a foot of a user of the exercise equipment, and control circuitry programmed to modify operation of the motor in response to detecting a pattern in the parameter as measured by the sensor.

Another implementation of the present disclosure is an exercise apparatus that includes a base having a force plate, an end effector configured for performance of an exercise by a user interacting with the end effector, a motor controllable to provide a force on the end effector, and a controller configured to stop or start providing the force on the end effector in response to detecting a pattern of taps by the user on the force plate.

Another implementation of the present disclosure is a method. The method includes exerting a force on a user of fitness equipment by operating a motor, detecting, using one or more sensors of the fitness equipment, a pattern of taps by a foot of the user on the fitness equipment, and, in response to detecting the pattern of taps by the foot of the user, controlling the motor to stop exerting the force on the user.

DETAILED DESCRIPTION

Figure 1:
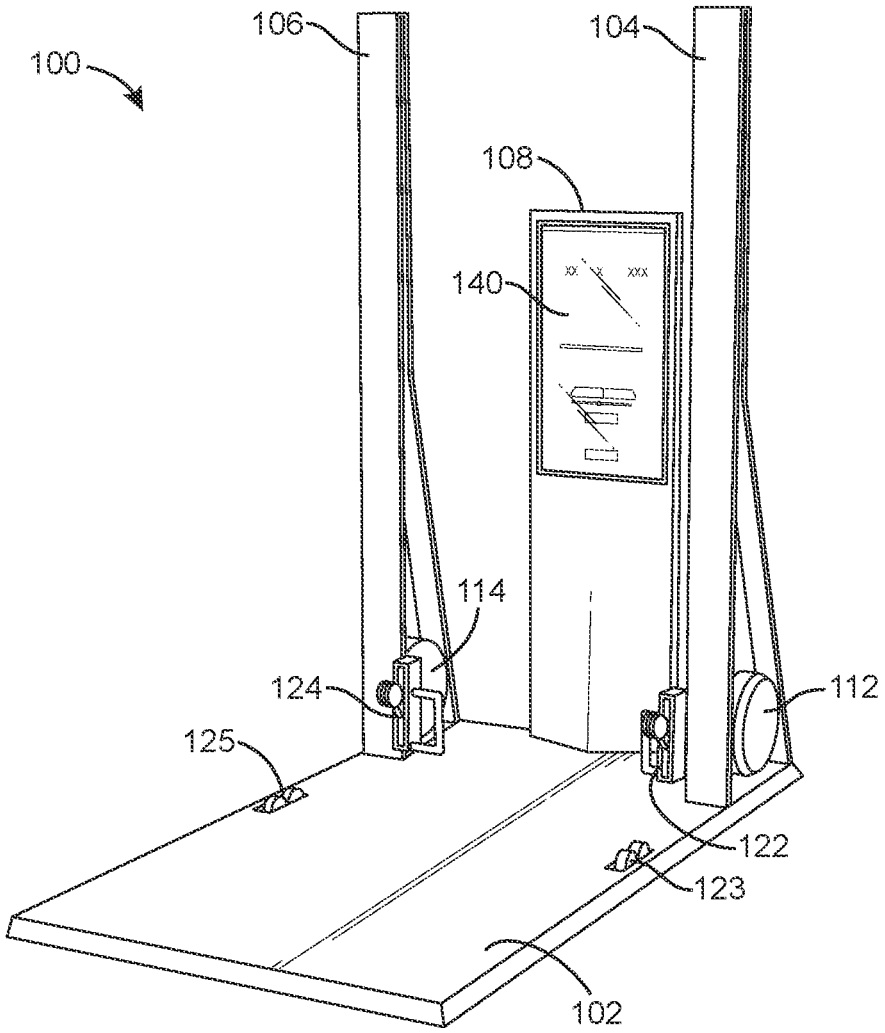
FIG. 1 is a perspective view of exercise equipment, according to some embodiments.

Referring generally to the figures, fitness equipment including an exercise apparatus and methods relating thereto are shown. In particular, an exercise apparatus configured as a motorized strength training apparatus is shown. In the fitness equipment (e.g., motorized strength training apparatuses) described herein, an electric motor operates to generate a tension in a cable. An exercise implement such as a handle, bar, etc. can be connected to the cable such that the tension is communicated to the exercise implement and a force is exerted on a user holding (or otherwise in contact with) the exercise implement. The force experienced by the user performing an exercise can thus be electronically controlled.

Electronic control of the force experienced by the user provides a wide variety of benefits. The present disclosure discloses features which enable a user to easily and reliably input, during performance of an exercise, a request for the force to be reduced or eliminated (e.g., to turn off resistance) without needing to return to a specific body position. Such a feature may be particularly advantageous to a user when fatigued and/or when reaching limits of the user's athletic ability, i.e., in situations where returning a traditional weight to a rack would be difficult or impossible for the user to physically achieve. Such features may also be advantageous in situations where the user is in an unintended or otherwise compromised position relative to the exercise equipment (e.g., due to slipping, loss of balance, etc.).

Exercise equipment enabled to reduce or eliminate the load on the user in response to an easy, reliable user input would therefore provide improved usability and may allow users to fully attack their personal limits to make new fitness gains, especially in embodiments where such form user input is accessible from most or all positions a user may be in when using the exercise equipment (including unintended or compromised positions). Accordingly, some embodiments herein accept as an input a pattern of taps of the user's foot, for example tapping (stepping, stomping, touching, marching, kicking, pushing, etc.) of the user's foot on a base platform of an exercise apparatus. Tapping of at least part of the user's foot (e.g., toe taps) can be available to a user across a wide variety of body positions and exercises (e.g., squat, bench press, etc.) and can be performed under fatigue of other muscle groups. Such inputs can be provided without a user needing to locate, mid-exercise, a particular button or an icon on a graphical user interface, which may be out of the user's reach in various scenarios.

Other commands can also be entered through detection of foot tapping, in various embodiments. For example, different patterns of taps can be detected and associated with different users requests or commands (e.g., start force, stop force, increase force, decrease force, advance to a next set, advance to a next exercise, start/stop timer, etc.).

These and other technical features and advantages are described in detail in the following passages.

Referring now to FIG. 1, an exercise apparatus 100 is shown, according to some embodiments. The exercise apparatus 100 can be used as a unit of fitness equipment and/or physical therapy equipment. The exercise apparatus 100 includes a base platform 102, a first stanchion 104 extending vertically from the base platform 102 proximate a first end of the base platform 102, a second stanchion 106 extending vertically from the base platform 102 proximate the first end of the base platform 102, a display console 108 coupled to the base platform 102 and positioned between the first stanchion 104 and the second stanchion 106. The exercise apparatus can also include a bench selectively positionable on the base platform 102. The exercise apparatus 100 also includes a first motor 112 positioned on the base platform 102 at the first stanchion 104 and a second motor 114 positioned on the base platform 102 at the second stanchion 106.

The exercise apparatus 100 can also include a first cable extending from the first motor 112 and a second cable extending from the second motor 114. The exercise apparatus 100 also includes a first terminal 122 coupled to the first stanchion and repositionable along the first stanchion 104, and a first set of pulleys 123 positioned at the base platform 102. In the state shown in FIG. 1, the first cable can extend from the first motor 112 along the first set of pulleys 123 to the first terminal 122, for example. Cable routing according to some embodiments is shown in U.S. patent application Ser. No. 17/495,584, filed Oct. 6, 2021, the entire disclosure of which is incorporated by reference herein in its entirety.

The exercise apparatus 100 also includes a second terminal 124 coupled to the second stanchion 106 and repositionable along the second stanchion 106, and a second set of pulleys 125 positioned at the base platform 102. In the state shown in FIG. 1, the second cable can extend from the second motor 114 along the second set of pulleys 125 to the second terminal 124, for example. Cable routing according to some embodiments is shown in U.S. patent application Ser. No. 17/495,584, filed Oct. 6, 2021, the entire disclosure of which is incorporated by reference herein in its entirety.

As shown in FIG. 1, the base platform 102 is substantially planar and is configured to stably rest on a floor or other ground surface to provide a stable foundation for the exercise apparatus 100. The base platform 102 can define an exercise surface on which a user can perform one or more exercise and/or on which the bench 110 can be positioned. In some embodiments, the base platform 102 is configured to be at least partially foldable into an out-of-use configuration in which the base platform 102 is folded up and away from the floor or ground under the base platform 102 (thereby reducing the space occupied by the exercise apparatus 100 when not in use). The base platform 102 can include one or more sensors configured to detect user interactions with the base platform 102, for example one or more force sensors, pressure sensors, load cells, accelerometers, acoustic sensors (microphones), etc. For example, the base platform 102 may include one or more force plates coupled to a frame of the base platform 102 so as to be slightly moveable, enabling the one or more force plates to measure (e.g., weigh) forces and/or pressures exerted thereon and/or accelerations thereof (e.g., caused by a user).

The display console 108 may be configured to display information relating to operation of the exercise apparatus 100 to a user. As shown in FIG. 1, the display console 108 includes a screen 140 (e.g., LED screen). In some embodiments, the screen 140 is a touchscreen configured to accept user input. In other embodiments, one or more additional buttons, keys, toggles, etc. are included on the display console 108 to receive user input. In some embodiments, the display console 108 includes one or more speakers configured to emit sounds relating to operation of the exercise apparatus 100. In some embodiments, the exercise apparatus 100 alternatively or additionally includes a virtual reality or augmented reality headset configured to be worn by a user and to display information relating to operation of the exercise apparatus 100 to the user. In some embodiments, the display console 108 houses a controller for the exercise apparatus 100.

The first stanchion 104 and the second stanchion 106 extend upwards from the base platform 102 and are spaced apart from one another near an end of the base platform 102. The first stanchion 104 and the second stanchion 106 are shown as being substantially symmetric across a center line of the base platform 102. As shown in FIG. 1, the first stanchion 104 and the second stanchion 106 are substantially the same height. The first stanchion 104 and the second stanchion 106 may be approximately six feet tall, for example with a height in a range between five feet and seven feet, as in the example of FIG. 1. In other embodiments, the first stanchion 104 and/or the second stanchion 106 may be shorter, for example with a height in a range between two feet and four feet.

The first terminal 122 is coupled to the first stanchion 104 and is configured to be selectively repositioned along the first stanchion 104. For example, the first terminal 122 may include a projection that rides along a groove or slot of the first stanchion 104 (or vice-versa) and can be selectively held in place at various heights using a pin configured to engage apertures of the first stanchion 104. The first terminal 122 can include a handle to facilitate repositioning of the first terminal 122. The second terminal 124 is coupled to the second stanchion 106 and is configured to be selectively repositioned along the second stanchion 106. For example, the second terminal 124 may include a projection that rides along a groove or slot of the second stanchion 106 (or vice-versa) and can be selective held in place at various heights using a pin configured to engage apertures of the second stanchion 106. The second terminal 124 can include a handle to facilitate repositioning of the second terminal 124. Accordingly, the first terminal 122 and the second terminal 124 can be repositioned (e.g., manually by a user) to various heights along the first stanchion 104 and the second stanchion 106, i.e., at various heights above the base platform 102. In some embodiments, actuators (e.g., linear actuators) are included in the first stanchion 104 and the second stanchion 106 to automatically move the first terminal 122 and the second terminal 124, for example as described in U.S. patent application Ser. No. 17/584,245, filed 20 Jan. 2022, the entire disclosure of which is incorporated by reference herein.

The first motor 112 is shown as being positioned on the base platform 102 at a bottom end of the first stanchion 104. The first motor 112 can be operationally coupled to a first cable such that the first motor 112 can generate tension in the first cable. In some examples, the first motor 112 can include an electric motor coupled to a spool such that the electric motor operates to generate a torque that rotates the spool. In such examples, the spool is coupled to a first cable such that the first cable can be repeatedly wound and unwound from the spool of the first motor 112 by operation of the first motor 112.

The first motor 112 is configured to controllably generate a force that acts both to retract a first cable towards the first motor 112 and to resist the first cable from being pulled out (unspooling, releasing) from the first motor 112. Thus, the first motor 112 can provide a controllable tension in the first cable in different phases (e.g., concentric and eccentric phases) of exercises performed using the exercise apparatus 100, for example providing different amounts of tension in different phases or otherwise dynamically altering the tension. In some embodiments, the first motor 112 includes a permanent magnet direct current motor. In various embodiments, the first motor 112 includes a belt, a gear, a set of gears, various gearing, etc.

The second motor 114 is shown as being positioned on the base platform 102 at a bottom end of the second stanchion 106. The second motor 114 is operationally coupled to a second cable such that the second motor 114 can generate tension in the second cable 120. Other than acting on the second cable 120 rather than the first cable 118, the second motor 114 is configured substantially the same as the first motor 112 in the examples shown. Various exercises that can be enabled by the operation of the first motor 112 and the second motor 114 are shown in U.S. patent application Ser. No. 17/495,584 filed Oct. 6, 2021, U.S. patent application Ser. No. 17/462,237 filed Aug. 31, 2021, and U.S. patent application Ser. No. 17/495,575 filed Oct. 6, 2021, the entire disclosures of which are incorporated by reference herein.

Figure 2:
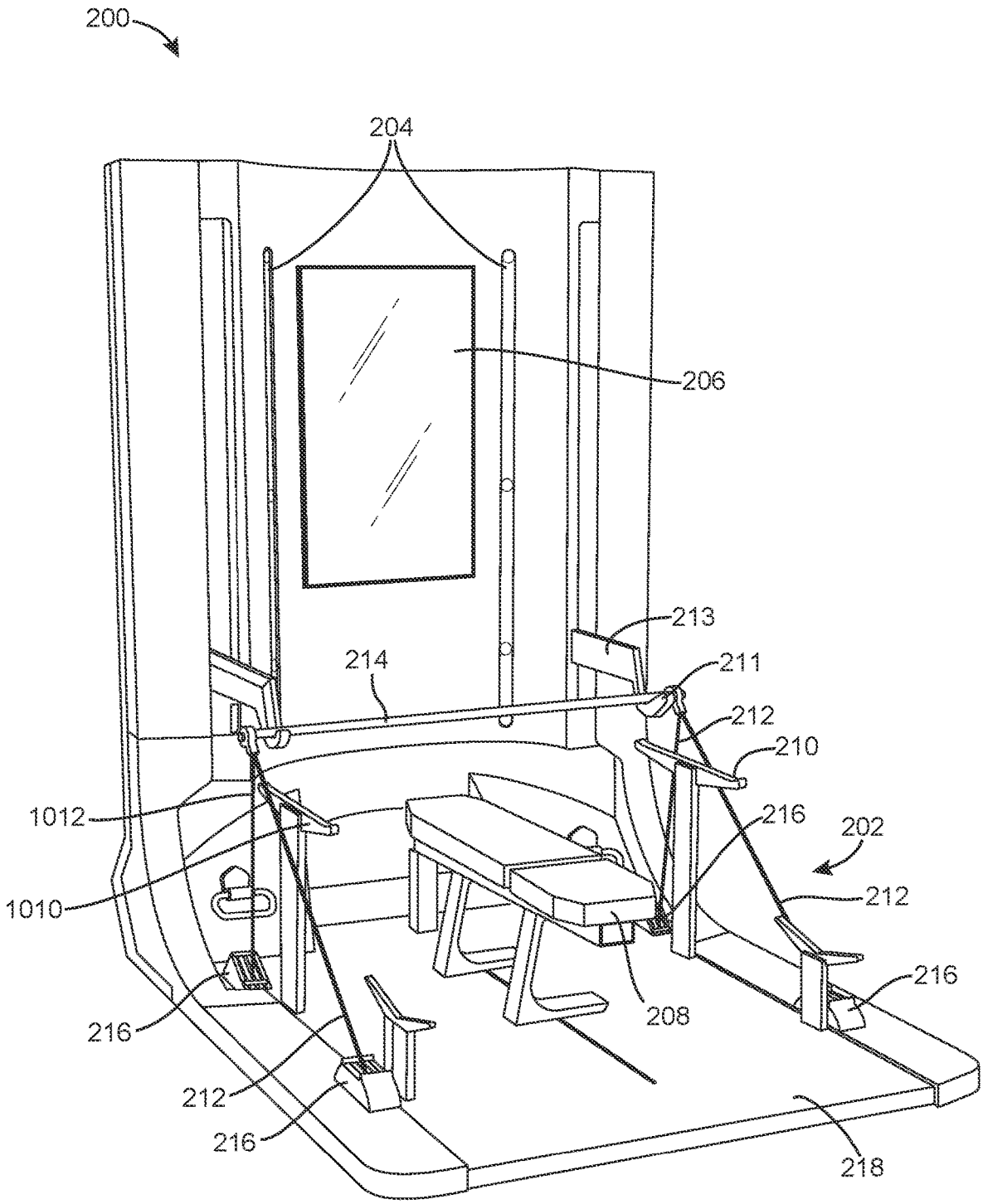
FIG. 2 is a perspective view of exercise equipment, according to some embodiments.

Referring now to FIG. 2, a perspective view of a fitness system 200 is shown, according to an example embodiment. The fitness system 200 is configured to provide a full fitness experience, including a resistance training experience. In particular, the fitness system 200 includes the a multi-cable force production system 202, a pacing lighting system 204, a display interface 206, an integrated bench 208, and adjustable rails 210.

The multi-cable force production system 202 can be configured as described in detail in U.S. patent application Ser. No. 16/909,003, filed Jun. 23, 2020, the entire disclosure of which is incorporated by reference herein. The multi-cable force production system 202 as shown here in FIG. 2 includes multiple (shown as four) cables 212 connected to a barbell 214 that can be selectively supported by cradles 211 supported by a frame 213. The cables 212 are connected to independent electric motors via separate pulleys 216. The electric motors can be operated to independently vary the tension in each cable in order to create a desired force profile at the barbell 214, as described in detail in the above-cited U.S. patent application Ser. No. 16/909,003.

The multi-cable force production system 202 is also shown as include platform (base, foundation, exercise surface, etc.) 218. Platform 218 can include one or more sensors configured to detect user interactions with the platform 218, for example one or more force sensors, pressure sensors, load cells, accelerometers, acoustic sensors (microphones), etc. For example, the base platform 218 may include one or more force plates coupled to a frame of the platform 218 so as to be slightly moveable, enabling the one or more force plates to measure (e.g., weigh) forces and/or pressures exerted thereon and/or accelerations thereof (e.g., caused by a user).

The pacing lighting system 204 can be configured as described in detail in U.S. patent application Ser. No. 17/010,573, filed Sep. 2, 2020, the entire disclosure of which is incorporated by reference herein. The pacing lighting system 204 as shown here in FIG. 2 includes a pair of vertically-arranged rows of lighting element configured to illuminate dots (points, circles, areas) of different colors. The dots illuminated on the pacing lighting system 204 can indicate to a user a desired/preferred range of motion for an exercise a real-time indication of the preferred position of the user (showing movement intended to be followed by the user), and a current position of the user (or barbell 214) relative to that range of motion. As shown in FIG. 2, the pacing lighting system 204 can be arranged parallel to a linear path along which the frame 213 can move, such that the pacing lighting system 204 can illuminate points that correspond to heights relative to the frame 213. In some cases, control of the pacing lighting system 204 and the linear positioning system for the frame 213 are coordinated so that an illuminated dot intended to guide the user's motion is aligned with the cradles 211 at the beginning and end of an exercise.

The display interface 206 is configured to show various instructions, exercise data, resistance amounts, exercise routines, and other information to a user. The display interface 206 may be a touchscreen to enable interaction between the user and the display interface 206. For example, the display interface 206 may be configured to accept user inputs requesting operations and changing settings for the fitness system 200, force production system 202, and/or pacing lighting system 204. Various customized exercise programs and content can be provided via the display interface 206, including as described in U.S. patent application Ser. No. 16/909,003 cited above and incorporated herein by reference.

The fitness system 200 is also shown as including an integrated bench 208 which can be selectively included or removed from the fitness system 200 to enable exercises suitable for performance using a bench (e.g., bench press). The integrated bench 208 may be configured to be coupled to the platform 218 in some embodiments. The integrated bench 208 can be adjustable to different inclinations for various exercises. In some embodiments, the integrated bench 208 includes sensors or electronics to facilitate use of the integrated bench with other elements of the fitness system 200.

The fitness system 200 is also shown as including adjustable rails 210. The adjustable rails 210 are positioned below the cradles 211 and along sides of the platform 218, and are configured to stop the bar from moving lower than height defined by the adjustable rails 210. The adjustable rails 210 can thus receive the barbell 214 when a user is unable to complete an exercise or otherwise wishes to place the barbell 214 somewhere other than in the cradles 211.

Various hardware and/or software of the various elements of the fitness system 200 can be integrated and/or interoperable to provide for a comprehensive, unified experience for users of the fitness system 200. For example, a control system for the fitness system 200 can control the force production system 202, the pacing lighting system 204, and the display interface 206. As one feature enabled by this integration, the force production system 202 can be controlled in coordinate with motorized movement of the cradles 211 by one or more actuators (e.g., as described in U.S. patent application Ser. No. 17/584,245, filed 20 Jan. 2022, the entire disclosure of which is incorporated by reference herein), for example either allowing the cables 212 to be extended as the cradles 211 move upwards or by retracting slack in the cables 212 as the cradles 211 move downwards. Various other integrations are also possible in various embodiments.

Figure 3:
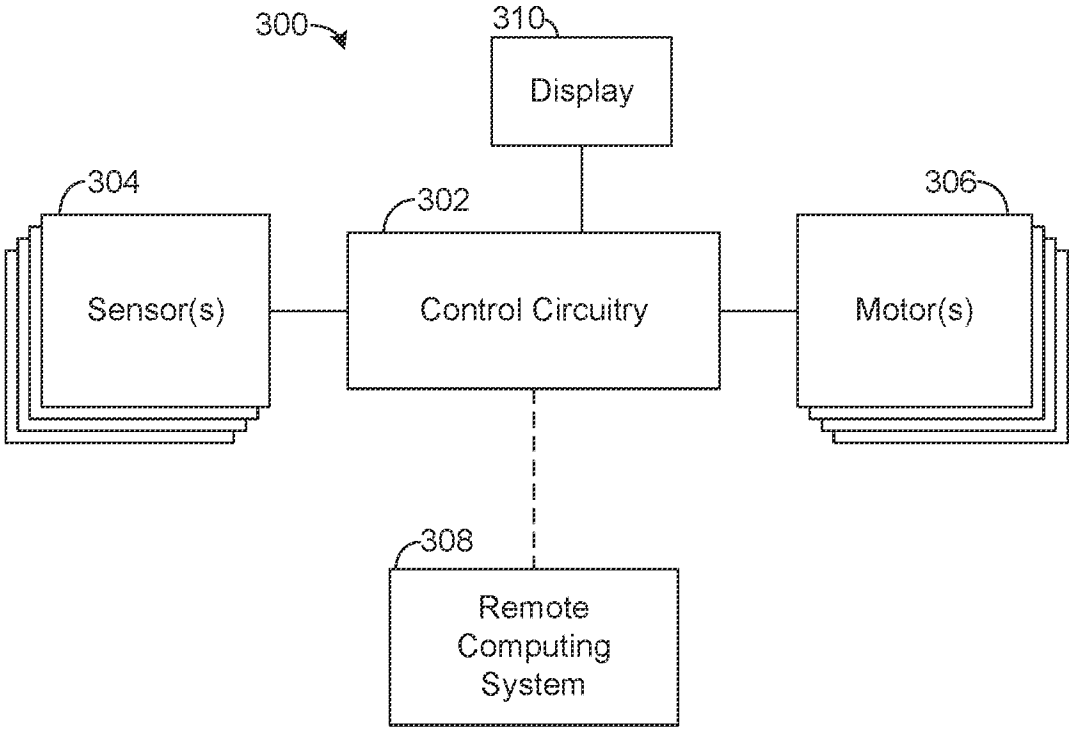
FIG. 3 is a block diagram of a control system that can be included with exercise equipment, according to some embodiments.

Referring now to FIG. 3, a block diagram of a control system 300 that can be included with the fitness system 200 or exercise apparatus 100 is shown, according to some embodiments. The control system 300 includes control circuitry 302 that receives data (signals, information, etc.) from one or more sensors 304 and controls one or more motors 306 (e.g., first motor 112 and second motor 114 of FIG. 1, motors of multi-cable force production system 202 of FIG. 2). The control circuitry 302 is also shown as being communicable with a remote computing system 308, for example via one or more networks (e.g., Internet, intranet, WiFi, cellular network, etc.) and connected to a display 310 (e.g., screen 140, display interface 206, pacing lighting system 204, personal computing device, smartphone, smartwatch, AR/VR headset, etc.).

In some embodiments, the control circuitry 302 includes input ports, pins, etc. wired to the sensors 304 such that the control circuitry 302 receives electronic signals from the sensors 304. The control circuitry 302 can also input outlet ports, pins, etc. conductively connected to the one or more motors 306 to control the one or more motors 306. In some embodiments, the control circuitry 302 includes memory and processing components (e.g., one or more memory devices and one or more processors) programmed to execute operations described herein.

The one or more sensors 304 can include one or more types of sensors in various embodiments. The one or more sensors 304 may be positioned at an exercise surface on which a user's foot (or feet) will be placed during an exercise (e.g., ground, floor, platform 102, base 218). In some embodiments, the one or more sensors 304 are integrated with the platform 102 of the exercise apparatus 100 of FIG. 1 or the base 218 of the fitness system 200 of FIG. 2. In other embodiments, a mat, surface, etc. including force sensors is provided mechanically separate from (e.g., other than communication connection to control circuitry 302), for example in embodiments where the platform 102 or base 218 is omitted. In other embodiments, the one or more sensors 304 are provided in wearable device, for example integrated into footwear or provided in a pod that can be attached to a user's footwear. The one or more sensors 304 are thus arranged to measure results of actions of the user's foot or feet.

In some embodiments, the one or more sensors 304 include one or more force sensors configured to measure a force or pressure (and/or detect changes in force or pressure). The one or more force sensors can include one or more load cells (e.g., piezoelectric load cells, inductive load cells, capacitive load cells, etc.), scales, strain gauges, force sensing resistor, fiber optic force sensor, and/or other type of force sensor in various embodiments. The one or more force sensors are configured to output data (e.g., digital information, analog signal, etc.) indicative of a force or pressure exerted on the sensor, for example a force or pressure provided by a user on the sensor (e.g., by tapping of the user's foot or feet).

In some embodiments, the one or more force sensors are positioned in a base of fitness equipment, for example in platform 102 of FIG. 1 or base 218 of FIG. 2. In some embodiments, force sensors are arranged or distributed so as to detect forces across a large surface area of the platform 102 or base 218. In some embodiments, the platform 102 or base 218 includes a force plate configured such that forces on the force plate are mechanically transferred to at least one of the one or more sensors 304. For example, a force plate may be positioned over one or more sensors 304 and moveable, at least slightly, relative to a frame of the platform 102 or base 218 so that the force plate can communicate force from a user to the one or more sensors 304. The force plate may be configured as a scale (e.g., electronic/digital scale) such that the force plate enables production of data indicative of forces (or changes therein) or on the platform 102 or base 218, for example forces created by tapping of a user's foot or feet on the platform 102 or base 218.

In some embodiments, the one or more sensors 304 include one or more accelerometers (e.g., piezoelectric accelerometers, piezoresistance accelerometers, capacitive accelerometers). An accelerometer provides data indicative of acceleration of the accelerometer. In some embodiments, one or more accelerometers are positioned at or in the platform 102 or base 218 and can measure movement associated with slight flexing or displacement of part of the platform 102 or base 218 under forces exerted from a user, including in some embodiments flexing or displacement that is imperceptible by the user, for example caused by tapping of the user's foot on the platform 102 or base 218. In other embodiments, one or more accelerometers can be provided in a wearable device (e.g., foot pod) or otherwise placed to measure accelerations caused by tapping movements of a user's foot or feet.

In some embodiments, the one or more sensors 304 include one or more acoustic sensors (e.g., microphones, micro-electromechanical systems (MEMS) microphones) configured to detect sound created by actions of a user such as tapping of the user's foot or feet on an element of exercise equipment (e.g., on the platform 102 or base 218) or on the ground, etc. For example, an acoustic sensor may be positioned in a cavity defined by the platform 102 or base 218 (e.g., on the underside of a surface supporting the user), such that tapping of the user's foot on the platform 102 or base 218 creates sound in the cavity which can then be detected by the one or more acoustic sensors.

The one or more sensors 304 can thus include one or more types of sensors (including combinations of types of sensors) to measure one or more parameters (e.g., force, pressure, acceleration, sound) affected by tapping of a foot or feet of a user of the exercise equipment. The one or more sensors 304 provide results of such measurements (data, signals, information, etc.) to the control circuitry 302, for example in substantially real-time (e.g., low or zero latency, high frequency, etc.).

The control circuitry 302 is configured to receive measurements from the one or more sensors 304 to detect occurrence of a pattern in the measurements of the one or more parameters. Occurrence of the pattern in the measurements indicates that a user has tapped in a manner detected by the one or more sensors and according to a defined (expected, intended, etc.) pattern. For example, the pattern may correspond to two taps within a certain amount of time, three taps within a certain amount of time, etc. As another example, the pattern may correspond to a tap, followed by a pause, followed by another tap (or various combinations and patterns of taps and pauses at different durations) (e.g., similar to Morse Code). As another example, the pattern may correspond to a particular rhythm of tapping (consecutive taps on even beats, syncopated taping, etc.).

The pattern may be associated with a particular command or request from the user to the control circuitry 302. For example, the pattern may be defined as a command to the control circuitry 302 to modify operation of the one or more motors 306, for example to turn off the one or more motors 306 or reduce or relax the force provided to the one or more motors 306 such that the load on the user is substantially removed. Some embodiments provide only one available tap-based command, which can allow users to easily remember how to input the particular command via tapping. Approaches for processing data from the sensors for pattern detection are described in detail below with reference to FIG. 3.

In some embodiments, the control circuitry 302 monitors the measurements from the one or more parameters detect occurrence of any of multiple patterns in the measurements. In various embodiments, different patterns can be associated with different commands (user requests) to the control circuitry 302. For example, a first pattern can be a request to control the motors to remove the load from the user, a second pattern can be a request to control the motors to slightly reduce the load on the user (e.g., by an increment of 5 pounds, 10 pounds, etc.), a third pattern can be a request to control the motors to start exerting a load on the user, a third pattern can be a request to control the motors to increase the load on the user (e.g., by an increment of 5 pounds, 10 pounds, etc.), a fourth pattern can be a request to advance to a next exercise in a workout plan (e.g., adjust the load on the user to an amount defined in the workout plan), and various other examples in various embodiments. Any number of such patterns and commands can be implemented in various embodiments, for example significantly different patterns to provide usability, allowing users to provide various different commands via foot taps so that loads can be adjusted without interaction with a touchscreen or other interfaces and from body positions often assumed during exercises.

In some embodiments, the control circuitry 302 provides a configuration routine (training routine, setup, etc.) which can provide training of the user and/or configuration of the pattern recognition executed by the control circuitry 302. Related features are described below with reference to FIG. 4. In some embodiments, the control circuitry 302 controls display 310 (e.g., causes graphics/images/text/etc. to be displayed by display 310) to provide instructions to a user with respect to the one or more tapping patterns, instruct a user to perform the tapping pattern and indicate to the user whether the tapping pattern has been successfully performed (i.e., providing feedback to the user so that the user can adjust the tapping until the user's tapping is successfully entered by the user), etc. in order to teach the user to use the tap-based command features described herein. In some embodiments, entry of a tap-based command may be required as a gateway to initiating a workout with the exercise equipment, such that the control system 300 ensures that a user knows how to provide the tapping pattern before allowing the one or more motors 306 to be controlled to exert force on the users.

In some embodiments, the control circuitry 302 is communicable with a remote computing system 308, for example via the Internet. The control circuitry 302 can include a wired communication port (e.g., Ethernet port) or wireless communication receiver (e.g., WiFi receiver) through which the control circuitry 302 can be communicably connected to a network to communicate with the remote computing system 308. The remote computing system 308 can be a server, group of servers, cloud computing resource, etc. in various embodiments. In some embodiments, the remote computing system 308 provides workouts, exercise plans, videos, etc. that can be used by the control circuitry 302 to control the motor(s) 306 and the display 310, for example as described in U.S. patent application Ser. No. 17/580,346, filed 20 Jan. 2022, the entire disclosure of which is incorporated by reference herein. The remote computing system 308 may also provide access control (e.g., user login) features to enable stored customization and personalization for use in operating the control system 300. In some embodiments, the remote computing system 308 is configured to train a model (e.g., neural network) to patterns in data from sensor(s) 304, for example based patterns caused by user interactions with the fitness equipment during a calibration/training/testing workflow. In some embodiments, the remote computing system 308 trains the model remotely and transmits the model to the control circuitry 302 for use locally on the control circuitry 302.

Figure 4:
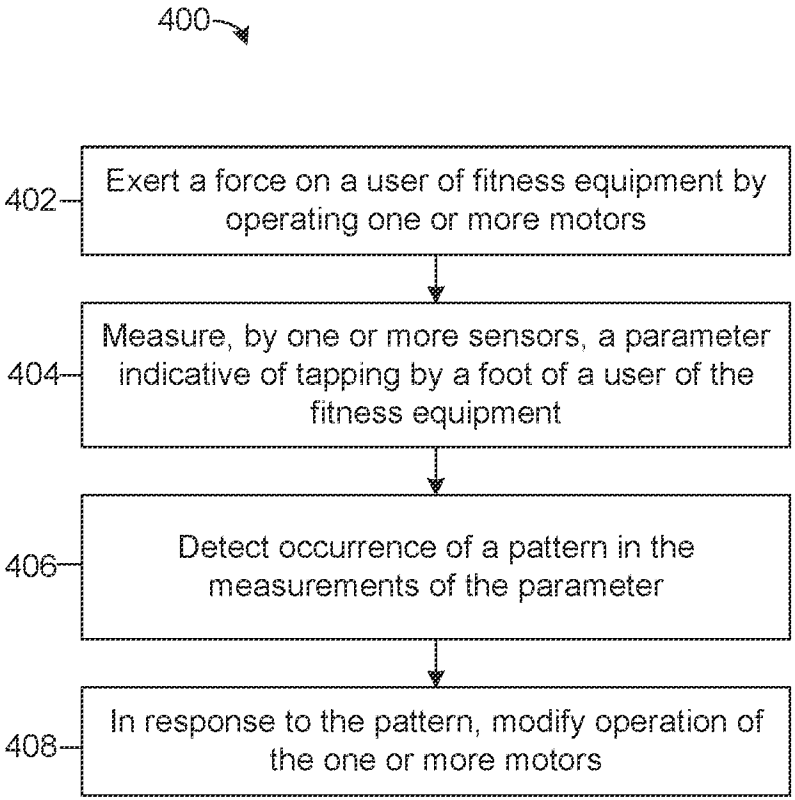
FIG. 4 is a flowchart of a process that can be executed by the control system of FIG. 3, according to some embodiments.

Referring now to FIG. 4, a flowchart of a process 400 for controlling fitness equipment is shown, according to some embodiments. The process 400 can be executed by the control system 300 operating with the fitness system 200 or exercise apparatus 100, in some embodiments, and reference is made thereto in the following description. In various other embodiments, other hardware and software elements can be used to implement the process 400.

At step 402, a force is exerted on a user of the fitness equipment by operating one or more motors 306. Step 402 can include the control circuitry 302 providing control signals, setpoints, operating parameters, etc. to the one or more motors 306, for example as described in U.S. patent application Ser. No. 16/909,003, filed Jun. 23, 2020, the entire disclosure of which is incorporated by reference herein. In some embodiments, the control circuitry 302 provides a feedback control or other type of control approach to cause the force exerted on the user by operation of the one or more motors 306 to track a desired magnitude and/or direction. Various approaches for operating the one or motors 306 are possible, including as described in U.S. application Ser. No. 17/462,237, filed Aug. 31, 2021 and U.S. application Ser. No. 17/495,75, filed Oct. 6, 2021, both of which are incorporated by reference herein.

At step 404, a parameter indicative of tapping by a foot of a user on the fitness equipment is measured by the one or more sensor(s) 304. In step 404, the sensor(s) 304 can measure force, pressure, noise, acceleration, and/or other parameter according to the different possible types of sensor (s) 304 that can be included as described above with reference to FIG. 3. Measurements can be performed substantially continuously, at a high frequency (e.g., greater than 1,000 Hz), etc. Step 404 can output one or more analog signals to the control circuitry 302, streams of measurement data, sets of measurement data, timeseries of measurement data, etc. in various embodiments.

At step 406, occurrence of a pattern is detected in the measurements of the parameter. Step 406 can be executed by the control circuitry 302 by applying one or more models or functions to the measurements from step 404, in various embodiments.

In some embodiments, step 406 includes applying a filter to the sensor measurements that differentiates signal(s) or data from the sensor(s) 304 as higher or lower, for example greater or less than a threshold value, e.g., detecting pulses or spikes in the signal(s) or data. The threshold value can be defined relative to a baseline value, for example a baseline value which can vary based on the exercise being performed, the amount of force exerted by the one or more motors, etc., so that the filter can differentiate expected effects on the parameter (force, pressure, etc.) from changes/increases associated with tapping of the user. In some embodiments, classifying readings as higher or lower is performed by comparing the force to a preceding measurement (e.g., higher or lower than a measurement of the parameter at a preceding time step) and determining whether an increase or decrease is transient (lasting less than a threshold duration, likely associated with a tap by the user) or sustained (lasting longer than a threshold duration, likely associated with a phase of the exercise being performed). The threshold duration in such examples can be approximately 100 milliseconds. These and other approaches can be used to find occurrences of pulses in the parameter as measured by the one or more sensors 304.

Step 406 can then include executing an event processing logic on the timing and number of detected pulses to determine whether a particular pattern occurred (e.g., whether two pulses occurred in less than a threshold duration, whether three pulses occurred in less than a threshold duration, whether one pulse occurred in a first time period and two pulses occurred in a second time period, etc.). In some embodiments, step 406 can include determining elapsed time between pulses and determining whether a pattern occurred based on the elapsed amount of time between two or more pulses.

In some embodiments, step 406 is executed using a convolutional function defined based on the tap sequence to be detected (i.e., the pattern in the parameter to be detected in step 406). A convolutional function is an expression that models the measurements which would occur if the user performs the tapping pattern and can be compared to the measurements in step 406 by determining the amount of overlap between the convolutional function and the measurements using a convolutional integral approach. The convolutional integral can be expressed as $\int_0^t f(\tau)g(t-\tau)d\tau$, where $f(\bullet)$ is the convolutional function defined based on the expected tapping pattern (e.g., non-zero for time steps $\tau$ corresponding to user taps and zero elsewhere) and $g(\bullet)$ is defined by real-time sensor data up to time t. By applying a convolutional integral constantly (e.g., at a frequency of the sensor data) to the sensor data, a value can be calculated which is indicative of the amount overlap between measurements of the parameter and the expected tapping pattern. When the value of the convolutional integral is greater than a threshold value, occurrence of the pattern is determined in step 406.

In some embodiments, an artificial intelligence (e.g., neural network, convolutional neural network, etc.) and/or machine learning based approach is used to detect the pattern in step 406. In such embodiments, step 406 can include preprocessing sensor data form the one or more sensor(s) 304 to generate inputs to the machine learning model and classifying, by the machine learning model, the inputs as corresponding to the pattern or not corresponding to the pattern. The model can be trained using a supervised approach in which people perform both the desired tapping pattern and other tapping actions while providing separate inputs indicating whether the provided tapping was or was not intended to be the desired tapping pattern. The combination of such data can be used for model training so that the machine learning model learns to replicate those associations. Model training is executed by the remote computing system 308 in some embodiments.

Various approaches can thus be executed in step 406. In some embodiments, a combination of approaches (e.g., pulse filtering and event processing, convolutional integration, artificial intelligence) can be used together and/or run in parallel for robust and reliable pattern detection. In some embodiments, as described with reference to FIG. 5 below, various thresholds, functions, models, etc. can be tuned for individual users and/or for customized patterns for use in step 406. Step 406 is thereby enabled to output a determination that the pattern occurred.

At step 408, operation of the one or more motors 306 is modified in response to the occurrence of the pattern (e.g., in response to the output from step 406). In some embodiments, step 408 includes controlling the one or more motors 306 to stop exerting a perceptible force on the user. In some embodiments, step 408 includes controlling the one or more motors 306 to incrementally increase or decrease the amount of force exerted on the user (e.g., increase or decrease an effective weight on the user by 5 pounds, 10 pounds, etc.). In some embodiments, step 408 includes advancing a workout plan to a next exercise in the workout plan and modifying operation of the one or more motors to provide forces appropriate for the next exercise. Step 406 can include these and other modifications to control of the one or more motors 306 in various embodiments.

Figure 5:
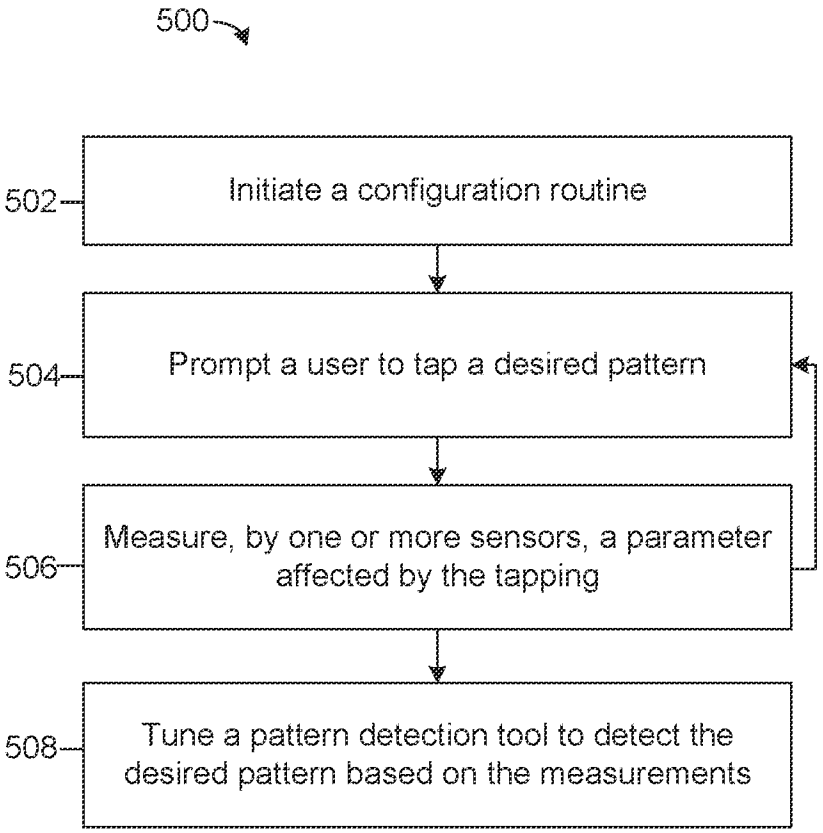
FIG. 5 is a flowchart of another process that can be executed by the control system of FIG. 3, according to some embodiments.

Referring now to FIG. 5, a flowchart of a process for configuring a tap detection process is shown, according to some embodiments. Process 500 can be executed by the control system 300 in some embodiments. Process 500 can output a pattern detection tool (model, function, threshold, rule, algorithm, etc.) for use in step 406 of process 400.

At step 502, a configuration routine is initiated. Step 402 can be included receiving a user request to enter the configuration routine, for example via an input to display 310 (e.g., touchscreen interaction, voice command, etc.) or other user interface device. The display 310 may be controlled to provide a graphical user interface that includes a selectable option to enter the configuration routine.

At step 504, a user is prompted to tap a desired pattern. In some embodiments, step 504 includes displaying instructions to the user via display 310 to perform a particular pattern (e.g., a pre-programmed pattern, an expected pattern, a manufacturer-defined pattern, a factory default pattern, etc.). In such examples, a video, illustration, animation, etc. can be displayed showing the particular pattern such that the user is clearly informed how to perform the particular pattern. The user is then expected to perform actions that the users believes are consistent with the particular instructions, but which may vary from a default or average behavior due to unique characteristics and behaviors of the user.

In other embodiments, step 504 includes prompting the user to input a custom pattern. In such embodiments, the display 310 can be caused to present a graphical user interface with instructions informing the user to performing any pattern of taps that the user wishes to associate with a command to the control system 300. Step 504 can include allowing a user to select a command (request, control modification, effect, etc.) for the control system 300 to execute (e.g., in step 408) in response to the user inputting the pattern during use of the fitness equipment.

At step 506, a parameter affected by the user tapping resulting from step 504 is measured by the one or more sensors 304. Step 506 can be implemented similarly to step 404, for example. Step 506 can include storing timeseries data for a time period during which the user performs tapping actions as prompted by step 504.

As shown in FIG. 5, process 500 can repeat multiple iterations of steps 504 and 506 to collect multiple sets of data in which the user performs the desired tapping pattern. For example, steps 504 and 506 can be repeated three, four, five, ten, twenty, or more times in various embodiments. In some embodiments, process 500 includes determining whether more data is needed (e.g., based on an automated assessment of the quality and quantity of data collected) and prompting the user to tap the desired pattern again in step 504 in response to a determination that more data is needed for process 500 to continue successfully.

At step 508, a pattern detection tool is tuned to detect the desired pattern based on the measurements collected in step 506. The pattern detection tool can be configured according to any of the approaches described with reference to step 406 above. In examples where pattern detection is performed by filtering data to detect pulses and assessing the timing of the detected pulses, step 408 can include tuning thresholds used to classify pulses and/or durations used in assessing timing of the pulses to better associate such values with the magnitude and/or timing of the tapping performed by the user in the configuration routine. In examples where pattern detection is performed using a convolutional function, the convolutional function can be defined or adjusted to track the tapping performed in the configuration routine, for example so that the convolutional function is based on a regression fit to the data collected in step 406.

In examples where pattern detection is performed using a machine learning approach, the machine learning model can be updated via a transfer learning process to tune an existing model (e.g., pre-trained from data collected by a manufacturer) to the particularities of the particular user. For example, in some such examples, a subset of weights of a neural network may be adjustable in step 508 while others are maintained from the existing model. As another example, thresholds used in post-processing outputs of a neural network can be used to optimize false-positive and false-negative rates for the particular user. In other embodiments, a machine learning model is fully retrained for a new pattern that the user desires to use as an input to the control system 300.

Step 508 thereby results in a pattern detection tool with tuned thresholds, durations, functions, weights, etc. specific to the particular user which can then be used in execution of step 406. Such information can be stored in a user account, for example with other user information such as a user ID, a user workout history, a user workout plan, user biometric information, etc., locally on the control circuitry 302 or remotely on the remote computing system 308. A user can login to an account for the user when using the fitness equipment disclosed herein, and in response to such a login the user-specific pattern detection tool from step 508 can be loaded for execution in process 400 while that user uses the exercise equipment. The configuration routine of process 500 may thus be performed during an initial account creation and/or setup workflow and stored for future use of the exercise equipment. The features disclosure herein thereby a user-friendly input mode that can be exercised under many user conditions (fatigue, etc.) and body positions (squat, bench press, lunge, standing, sitting, etc.) and can be user-tuned is provided for control of the one or more motors of the exercise equipment described herein.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of function. One or more of various types of processors can be provided with such computer-readable media for executing the various tasks, operations, functions, etc. described herein.

What is claimed is:

1. Exercise equipment comprising:

a motor;

a cable coupled to the motor such that the motor is operable to create a tension in the cable;

a sensor arranged to measure a parameter affected by tapping of a foot of a user of the exercise equipment;

control circuitry programmed to;

provide a configuration routine comprising defining a pattern based on user actions detected by the sensor; and modify operation of the motor in response to detecting the pattern in the parameter as measured by the sensor.

2. The exercise equipment of claim 1, further comprising a base configured to provide an exercise surface for the user of the fitness equipment, wherein the sensor is positioned at the base.

3. The exercise equipment of claim 2, wherein the sensor is a force or pressure sensor configured to measure a force or pressure exerted by the user on the base.

4. The exercise equipment of claim 2, wherein the base comprises a frame and a plate positioned in the frame, wherein the sensor measures an interaction of the user with the plate.

5. The exercise equipment of claim 1, wherein the control circuitry is configured to detect the pattern by applying data from the sensor as inputs to a machine learning model.

6. The exercise equipment of claim 5, wherein the controller is configured to tune the machine learning model based on the user actions detected by the sensor during the configuration routine.

7. The exercise equipment of claim 1, wherein the sensor is an accelerometer.

8. The exercise equipment of claim 1, wherein the pattern corresponds to a series of taps by the user.

9. The exercise equipment of claim 1, wherein the control circuitry is programmed to modify operation of the motor by reducing or eliminating the tension in the cable in response to detecting the pattern.

10. The exercise equipment of claim 1, wherein the control circuitry is configured to detect the pattern by applying a convolutional integral to data from the sensor, the convolutional integral using a convolutional function defined based on the pattern.

11. The exercise equipment of claim 1, wherein the control circuitry is configured to detect the pattern using a machine learning model.

12. An exercise apparatus, comprising:

a base comprising a force plate;

an end effector configured for performance of an exercise by a user interacting with the end effector;

a motor controllable to provide a force on the end effector; and a controller configured to:

tune a machine learning model based on user interactions with the force plate during a training routine;

detect a pattern of taps by applying data from the force plate as inputs to the machine learning model; and stop or start providing the force on the end effector in response to detecting the pattern of taps by the user on the force plate.

13. The exercise apparatus of claim 12, wherein the force plate comprises one or more force sensors configured to provide data to the controller.

14. The exercise apparatus of claim 12, wherein the force plate provides an exercise surface supporting the user during performance of the exercise by the user.

15. The exercise apparatus of claim 12, wherein the controller is configured to detect the pattern of taps by applying a convolutional integral to data from the force plate.

16. The exercise equipment comprising:

a motor;

a cable coupled to the motor such that the motor is operable to create a tension in the cable;

a sensor arranged to measure a parameter affected by tapping of a foot of a user of the exercise equipment;

control circuitry programmed to modify operation of the motor by:

reducing or eliminating the tension in the cable in response to detecting a first pattern in the parameter as measured by the sensor; and increasing the tension in the cable in response to detecting a second pattern in the parameter as measured by the sensor, the second pattern different from the first pattern.

17. The exercise equipment of claim 8, wherein the control circuitry is further programmed to provide a configuration routine, wherein the configuration routine comprises defining the first pattern based on user actions detected by the sensor.

18. A method, comprising:

exerting a force on a user of fitness equipment by operating a motor;

detecting, using one or more sensors of the fitness equipment, a pattern of taps of a foot of the user on the fitness equipment by applying a convolutional integral to data from the one or more sensors; and in response to detecting the pattern of taps by the foot of the user, controlling the motor to stop exerting the force on the user.

19. The method of claim 18, wherein detecting the pattern of taps comprises detecting a sequence of deviations from a baseline signal from the one or more sensors.

20. The method of claim 18, wherein detecting the pattern of taps comprises processing data from the one or more sensors using a machine learning model.

* * * * *